US008979497B2

(12) United States Patent
Wellenkamp et al.

(10) Patent No.: US 8,979,497 B2
(45) Date of Patent: Mar. 17, 2015

(54) BLADE ARRANGEMENT, ESPECIALLY STATOR BLADE ARRANGEMENT

(75) Inventors: Ulrich Wellenkamp, Windisch (CH); Sejko Kolev, Birr (CH)

(73) Assignee: Alstom Technology Ltd., Baden (CH)

( * ) Notice: Subject to any disclaimer, the term of this patent is extended or adjusted under 35 U.S.C. 154(b) by 605 days.

(21) Appl. No.: 13/281,480

(22) Filed: Oct. 26, 2011

(65) Prior Publication Data

US 2012/0107111 A1 May 3, 2012

(30) Foreign Application Priority Data

Oct. 27, 2010 (CH) ..... 1787/10

(51) Int. Cl.
*F01D 11/08* (2006.01)
*F01D 5/30* (2006.01)
*F01D 5/32* (2006.01)
(Continued)

(52) U.S. Cl.
CPC ..... *F01D 5/3038* (2013.01); *F01D 5/32* (2013.01); *F01D 9/042* (2013.01); *F01D 11/008* (2013.01); *F05B 2260/301* (2013.01)
USPC ..... 416/215; 416/248

(58) Field of Classification Search
CPC ..... F01D 5/303; F01D 5/3038; F01D 5/3046; F01D 9/042; F01D 25/243; F01D 11/008
USPC ..... 416/215, 204 A, 216, 217, 248; 415/189, 190, 208.1, 208.2–209.3
See application file for complete search history.

(56) References Cited

U.S. PATENT DOCUMENTS 3,216,700 A * 11/1965 Bostock, Jr. ..... 416/216
4,684,325 A * 8/1987 Arnold ..... 416/215
5,522,706 A 6/1996 Mannava et al.
(Continued)

FOREIGN PATENT DOCUMENTS

EP 1548232 6/2005
EP 1803900 A1 7/2007
(Continued)

OTHER PUBLICATIONS

European Patent Office, European Search Report Application No. 11185808.0 (Feb. 20, 2012).
(Continued)

*Primary Examiner* — Dwayne J White
*Assistant Examiner* — Brian P Wolcott
(74) *Attorney, Agent, or Firm* — Buchanan Ingersoll & Rooney PC

(57) ABSTRACT

A blade arrangement on a wall of a fluid flow path of a turbomachine includes a locating channel disposed in the wall and having undercut flanks. A plurality of blades each having a blade-side root section corresponding to the undercut flanks. A plurality of intermediate filling pieces correspond to the undercut flanks and separate each of the blade-side root sections. The plurality of blade-side root sections and intermediate filling pieces are seated in a form-fitting manner and fixed in a force-locking manner in the locating channel. The plurality of intermediate filling pieces fill out the locating channel so as to form a gas flow-side surface essentially free of a disturbing contour between the blade-side root sections. Each of the plurality of intermediate filling pieces includes a threaded hole disposed essentially perpendicular to a base of the channel. A screw is disposed in the threaded hole.

6 Claims, 2 Drawing Sheets

(51) Int. Cl.
*F01D 9/04* (2006.01)
*F01D 11/00* (2006.01)

(56) References Cited

U.S. PATENT DOCUMENTS

| | | | | |
|---|---|---|---|---|
| 6,752,598 | B2 * | 6/2004 | Antunes et al. | 416/215 |
| 7,114,927 | B2 * | 10/2006 | Bachofner et al. | 416/213 R |
| 7,192,256 | B2 * | 3/2007 | Bachofner et al. | 416/212 A |
| 7,435,055 | B2 * | 10/2008 | Hansen et al. | 416/215 |
| 8,157,530 | B2 * | 4/2012 | Krutzfeldt et al. | 416/220 R |
| 2006/0222502 | A1 | 10/2006 | Hansen et al. | |
| 2007/0280831 | A1 | 12/2007 | Pickens et al. | |
| 2009/0016889 | A1 | 1/2009 | Krutzfeldt et al. | |

FOREIGN PATENT DOCUMENTS

| | | | | |
|---|---|---|---|---|
| EP | 1865153 | A2 | 12/2007 | |
| GB | 2156908 | A * | 10/1985 | F01D 5/30 |
| GB | 2 171 150 | A | 8/1986 | |

OTHER PUBLICATIONS

European Patent Office, European Search Report in Swiss Patent Application No. 1787/2010 (Feb. 25, 2011).

* cited by examiner

BLADE ARRANGEMENT, ESPECIALLY STATOR BLADE ARRANGEMENT

CROSS REFERENCE TO PRIOR APPLICATIONS

Priority is claimed to Swiss Patent Application No. CH 01787/10, filed Oct. 27, 2010, the entire disclosure of which is hereby incorporated by reference herein.

FIELD

The invention relates to a blade arrangement, especially to a stator blade arrangement, on a wall of a fluid flow path of a turbomachine, especially of a gas turbine.

BACKGROUND

EP 1 803 900 A1 shows a locking sub-assembly with which the remaining gap between a first and a last blade of a blade ring, which are inserted in a circumferential groove of a turbomachine, is to be closed. In this case, it essentially concerns a two-piece intermediate piece which is arranged between the roots of the first and the last blade and which can be clamped by means of screw elements against the undercut flanks of the circumferential groove.

EP 1 548 232 A1 shows the arrangement of stator blades of a turbomachine, wherein the stator blades have stator blade roots which are seated in a form-fitting manner in a circumferential groove, having undercut flanks, of a stator blade carrier. Between adjacent stator blade roots, filling pieces, which determine the spacing of the stator blade roots in the circumferential direction, are arranged in the circumferential groove. In order to fix the filling pieces without clearance, provision is made on the base of the circumferential groove for groove-like recesses with annular pressure segments, arranged therein, which force the filling pieces away from the base of the circumferential groove which accommodates them so that the filling pieces, by corresponding profiles, butt against the undercut flanks of the circumferential groove in a force-locking manner. The pressure segments can make installation or removal of the filling pieces considerably more difficult.

GB 2156908 A relates to a rotor arrangement of a turbomachine. In this case, it is intended to insert the rotor blades of the rotor by correspondingly formed rotor blade roots into a rotor-side locating channel, wherein the rotor blade roots, by corresponding profiles, are retained in a form-fitting manner in undercuts on the flanks of the channel. For securing the rotor blade roots in the longitudinal direction of the channel, provision is made for a locking piece which, by means of a clamping screw, can be clamped in a form-fitting and force-locking manner between the undercuts of the flanks of the channel and the base of the channel.

U.S. Pat. No. 5,522,706 also relates to the securing of rotor blade roots, specifically in the longitudinal direction of a rotor-side channel which accommodates the rotor blade roots. In this case, locking pieces are arranged on both sides of a rotor blade root, which locking pieces are installed after arranging the rotor blade roots in the channel and can be fixed inside the channel between flank-side undercuts and the base of the channel by means of clamping elements, which are not described in more detail (in the drawing, clamping screws are shown only by way of indication). At no point is it shown or indicated that the locking pieces are to fill out the locating channel for the rotor blade roots between the rotor blades to form a surface which is essentially free of disturbing contours.

EP 1 865 153 A2 shows the arrangement of rotor blades on a compressor disk. This has a circumferential channel, with undercut flanks, which accommodates correspondingly matched rotor blade roots in a form-fitting manner. For securing the rotor blade roots, a locking piece is arranged inside the locating channel and, in the inserted state, fits beneath undercut flanks of the locating channel and, by means of a clamping screw which engages in a recess on the base of the channel, can be clamped inside the channel in a force-locking and form-fitting manner. Here also, it is neither shown nor indicated that the locking piece could form a surface between the adjacent rotor blades which is free of disturbing contours.

The prior art shows no blade arrangement in which filling pieces, which are arranged between adjacent blades or between their roots, form a surface between the blades which is essentially free of disturbing contours on the one hand, and on the other hand can be clamped inside an undercut locating channel in a form-fitting and force-locking manner.

SUMMARY OF THE INVENTION

In an embodiment, the present invention provides a blade arrangement on a wall of a fluid flow path of a turbomachine. The arrangement includes a locating channel disposed in the wall and having undercut flanks A plurality of blades each having a blade-side root section corresponding to the undercut flanks A plurality of intermediate filling pieces correspond to the undercut flanks and separate each of the blade-side root sections. The plurality of blade-side root sections and intermediate filling pieces are seated in a form-fitting manner and fixed in a force-locking manner in the locating channel. The plurality of intermediate filling pieces fill out the locating channel so as to form a gas flow-side surface essentially free of a disturbing contour between the blade-side root sections. Each of the plurality of intermediate filling pieces includes a threaded hole disposed essentially perpendicular to a base of the channel. A screw is disposed in the threaded hole, the screw being adjustable so as to be clampable against the base of the channel

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
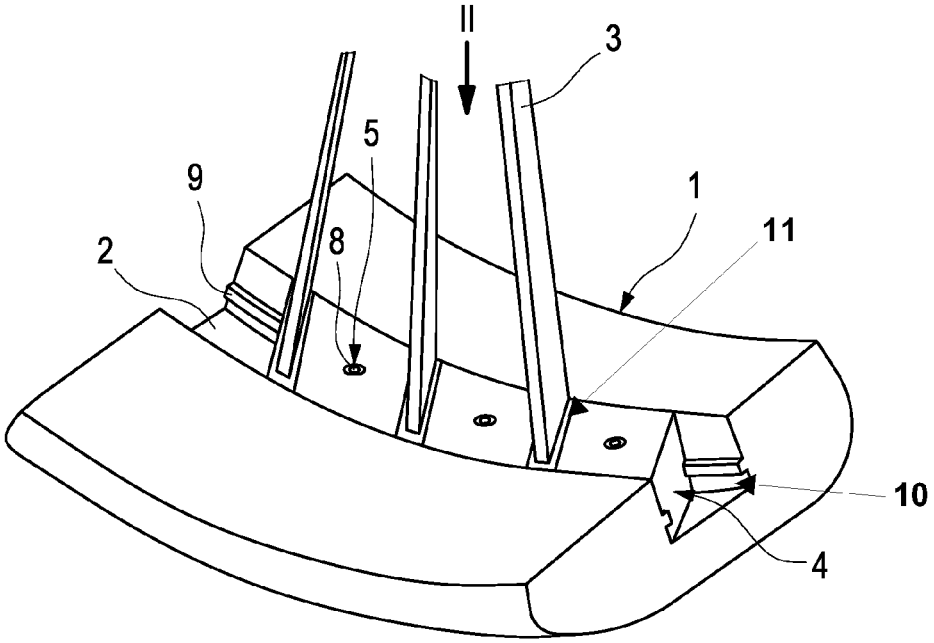
FIG. 1 shows a perspective view of a compressor casing segment with locating channel and blading accommodated therein.

In an embodiment, the present invention provides a blade arrangement on a wall of a fluid flow path of a turbomachine, especially of a gas turbine, wherein in a locating channel—formed in the wall—with undercut flanks, correspondingly matched blade-side root sections and intermediate filling pieces, which separate the root sections, are seated in a form-fitting manner and fixed in a force-locking manner for mounting of the blades.

In embodiment, the invention provides a new mounting for the blading of a turbine or the like.

In particular, an easy exchangeability of the intermediate filling pieces is to be ensured in the process.

To this end, it is provided according to an embodiment of the invention that the intermediate filling pieces have threaded holes which are essentially perpendicular to the base of the channel and with screws screwed into them, which screws, by means of screw adjustment, can be clamped against the base of the channel.

An embodiment of the invention is based on the general idea of arranging screws on the intermediate filling pieces, with which the intermediate filling pieces can be fixed in the locating channel in a force-locking manner. The screws, moreover, are captively arranged.

Since in this way each intermediate filling piece can be clamped separately in the locating channel, each intermediate filling piece can be adjusted and fixed independently of other filling pieces. Furthermore, removal of the intermediate filling piece is also easily possible.

In other respects, with regard to preferred features of the invention, reference is to be made to the claims and to the subsequent explanation of the drawing, on the basis of which a preferred embodiment of the invention is described in more detail.

Protection is claimed not only for the disclosed or depicted feature combinations but also for principally any combinations of the disclosed or depicted individual features.

The invention shall subsequently be explained in more detail with reference to an exemplary embodiment and to FIGS. 1 to 4.

Figure 2:
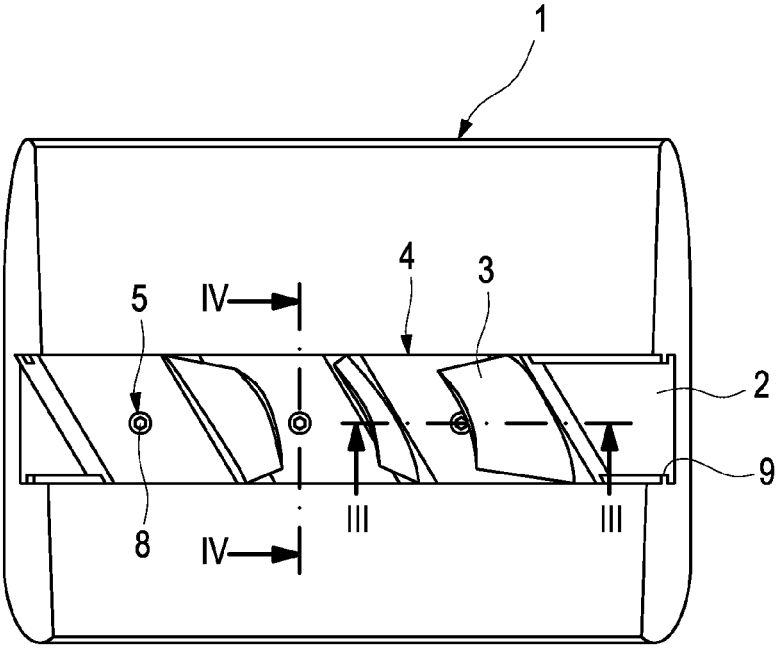
FIG. 2 shows a plan view of this casing segment corresponding to the arrow II in FIG. 1.

According to FIG. 1 and FIG. 2, a compressor casing segment 1, on its side facing the gas flow which is to be compressed, has a locating channel 2 with encompassing ribs 9. In this case, in the depicted example, undercuts 10 are formed by means of the rib-like projections which are arranged on the flanks of the channel. Inserted into the locating channel 2 are stator blades 3 with root sections 11 which are formed on them and matched to the cross section of the locating channel 2. Arranged in each case between the root sections 11 of adjacent stator blades 3 are intermediate filling pieces 4 which are matched to the cross section of the channel, and on the one hand fill out the channel 2 so that the casing segment 1 maintains a surface on the gas flow side which is essentially free of disturbing contours. On the other hand, a predetermined spacing between adjacent stator blades 3 is ensured by means of the intermediate filling pieces 4.

Figure 3:
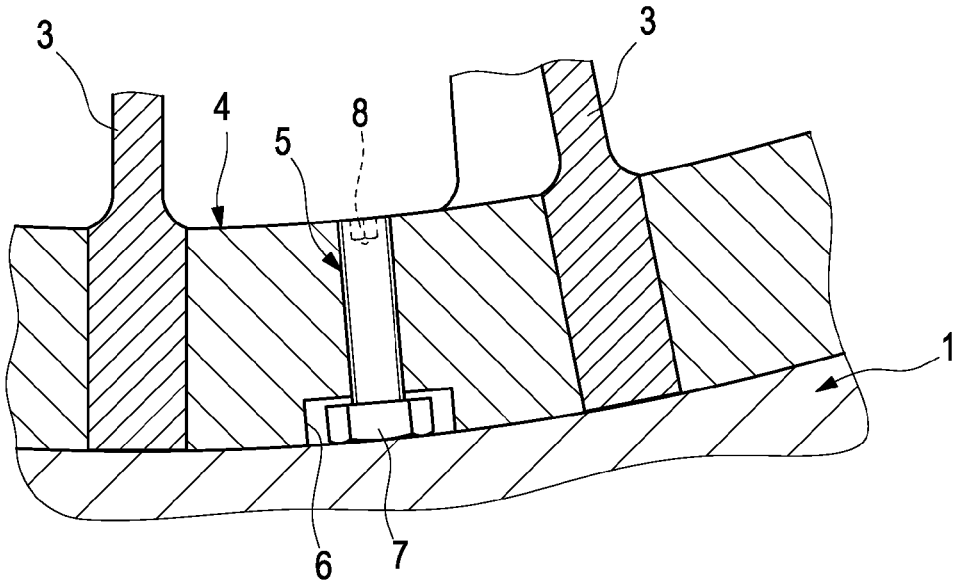
FIG. 3 shows a sectional view corresponding to the line of intersection III-III in FIG. 2.
Figure 4:
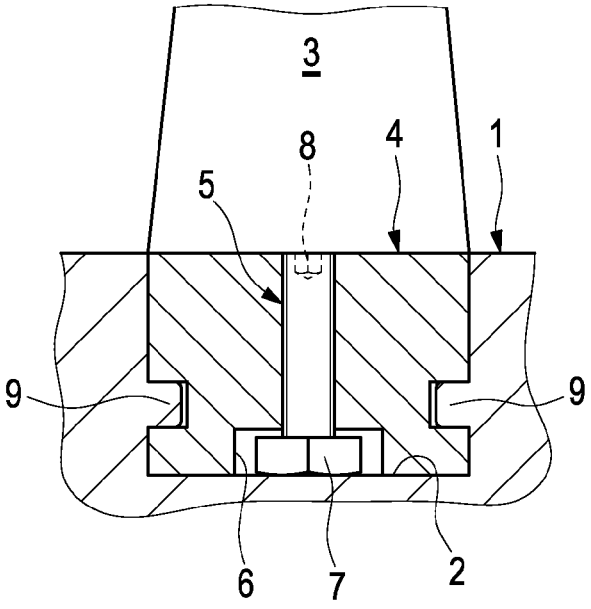
FIG. 4 shows a sectional view corresponding to the line of intersection IV-IV in FIG. 2.

According to FIGS. 3 and 4, the intermediate filling pieces 4 are penetrated in each case by a threaded hole which is essentially perpendicular to the base of the locating channel 2 and accommodates a screw 5. This threaded hole, on the side of the intermediate filling pieces 4 facing the base of the channel, opens into a recess 6 which is arranged there, which recess is open towards the base of the channel and is able to accommodate an end piece 7 which is arranged on the screw 5. On the end of the screw 5 facing away from the end piece 7, provision is made for a hexagon socket 8 or the like for the positioning of a screw-rotating tool with which the screw 5 can be screw-adjusted in the threaded hole of the intermediate filling piece 4. According to an embodiment of the invention, it is now intended to clamp the screws 5, by means of the aforesaid screw-rotating tool, by their end pieces 7 against the bottom of the locating channel 2. In this way, the form-fit of the respective intermediate filling piece 4 with the undercuts 10 on the flanks of the locating channel 2 (encompassing ribs 9), is made to be clearance-free, with force-locking fixing of the respective intermediate filling piece 4.

In the example of FIG. 4, rib-like projections 9 are formed on the flanks of the channel 2 and project into corresponding grooves on the flanks of the intermediate filling pieces 4. If, by means of screw-adjustment, the screw 5 by its end piece 7, or head, is now clamped against the base of the locating channel 2, a corresponding pressure acts between the lateral face of the rib 9 facing the base of the channel and the lateral face of the groove, formed in the intermediate filling piece 4, which faces the lateral face of the rib.

Providing the screw 5, in the clamped state of the intermediate filling piece 4, projects by its threaded portion from the upper side of the intermediate filling piece facing away from the base of the channel, an aftermachining is carried out in order to ensure an end face which is in alignment with the upper side of the intermediate filling piece 4. If necessary, said upper side of the intermediate filling piece 4 can also be aftermachined in order to ensure a smooth transition to the adjacent surfaces of the casing segment 1. In this way, a boundary surface which is free of disturbing contours for the fluid flow of the turbomachine is created between the stator blades.

The screw 5 is secured against loosening.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 Compressor casing segment
2 Locating channel
3 Stator blades
4 Intermediate filling pieces
5 Screw
6 Recess
7 End piece
8 Hexagon socket
9 Encompassing ribs, rib-like projections
10 Undercut
11 Blade-side root section

What is claimed is:

1. A stator blade arrangement on a wall of a fluid flow path of a turbomachine, the stator blade arrangement comprising:

a locating channel disposed in the wall and having undercut flanks;

a plurality of stator blades each having a blade-side root section corresponding to the undercut flanks; and a plurality of intermediate filling pieces corresponding to the undercut flanks and separating each of the blade-side root sections, the plurality of intermediate filling pieces and blade-side root sections being seated in a form-fitting manner and fixed in a force-locking manner in the locating channel, wherein the plurality of intermediate filling pieces fill out the locating channel so as to form a gas flow-side surface essentially free of a disturbing contour between the blade-side root sections, and wherein each of the plurality of intermediate filling pieces includes a threaded hole disposed essentially perpendicular to a base of the locating channel, wherein a screw is disposed in the threaded hole, the screw being adjustable so as to be clampable against the base of the locating channel, and wherein each of the plurality of intermediate filling pieces is adjusted and fixed independently of other intermediate filling pieces.

2. The stator blade arrangement as recited in claim 1, wherein the turbomachine is a gas turbine.

3. The stator blade arrangement as recited in claim 1, wherein each of the plurality of screws includes a stamp-like end piece having a cross section larger than a cross section of a threaded portion of the screw, wherein the stamp-like end piece is configured to clamp the screw against the base of the locating channel.

4. The stator blade arrangement as recited in claim 1, wherein each of the plurality of screws include a worm screw-like threaded portion having an end face facing away from the base of the locating channel and having an opening configured to accommodate a screw-turning tool, wherein the opening has a cross section that is not round.

5. The stator blade arrangement as recited in claim 3, wherein each of the plurality of intermediate filling pieces includes a recess facing the base of the locating channel configured to accommodate the stamp-like end piece during an installation of the intermediate filling piece.

6. The stator blade arrangement as recited in claim 1, further comprising rib-like projections extending in a longitudinal direction of the locating channel, and wherein each of the plurality of intermediate filling pieces includes a groove disposed on a side of the filling piece facing a side of the locating channel corresponding to each of the rib-like projections so as to accommodate the rib-like projections.

* * * * *